US005720600A

United States Patent [19]

Zakharov

[11] Patent Number: 5,720,600

[45] Date of Patent: Feb. 24, 1998

[54] SUCKER ROD PUMP

[76] Inventor: Boris Semenovich Zakharov, Leninsky pr., d. 125 Korp. 2, kv. 304, 117513, Moscow, Russian Federation

[21] Appl. No.: 557,150

[22] PCT Filed: Jun. 29, 1993

[86] PCT No.: PCT/RU93/00144

§ 371 Date: Mar. 15, 1996

§ 102(e) Date: Mar. 15, 1996

[87] PCT Pub. No.: WO95/01508

PCT Pub. Date: Jan. 12, 1995

[51] Int. Cl.[6] ..... F04B 1/12; F04B 47/02; F04B 47/12

[52] U.S. Cl. ..... 417/552; 417/554; 417/260; 166/68.5; 166/105

[58] Field of Search ..... 417/552, 554, 417/260; 166/685, 105

[56] References Cited

U.S. PATENT DOCUMENTS 2,684,638 7/1954 Sutton .
2,684,639 7/1954 Sutton .

FOREIGN PATENT DOCUMENTS 1084419 7/1984 U.S.S.R. .
1097242 1/1968 United Kingdom .

*Primary Examiner*—Charles G. Freay
*Assistant Examiner*—Samantha H. Moon
*Attorney, Agent, or Firm*—Hardaway Law Firm, P.A.

[57] ABSTRACT

A sucker rod pump comprises a cylindrical housing (1) having a suction valve (3), a hollow plunger (2) with a discharge valve (18) capable of reciprocating along the cylindrical housing (1) and at least two stationary sealing devices (7) spaced from each other for a distance equal to or higher than the length of the hollow plunger (2) which interacts with each sealing device (7) interacting, in turn, with the hollow plunger (2) whose length (L) is equal to or higher than the sum of the distance (H) between the adjacent sealing devices (7) and the length (B) of one sealing device (7) but less than the sum of the double distance (H) between the adjacent sealing devices (7) and the length (B) of one sealing device (7).

1 Claim, 2 Drawing Sheets g
H

SUCKER ROD PUMP

TECHNICAL FIELD

This invention relates to pumps lifting fluid from deep wells and, more particularly, the invention relates to sucker rod pumps.

PRIOR ART

Known in the art are plunger-type sucker rod pumps in which the plunger with a discharge valve moves in a hydraulic cylinder equipped with a suction valve, wherein the internal surface of the hydraulic cylinder features high hardness and is machined with a high accuracy. The plunger is also made with a high accuracy and has a reciprocating sealing device being a small clearance seal or an elastic sealing assembly made in the form of lip seals or piston rings (cf. A. B. Bezzubov, Yu. V. Schelkalin "Oil Lifting Pumps", Moscow, Nedra, 1986, p. 187, FIG. 81).

The prior art pumps have a precision pair "hydraulic cylinder—plunger", in which the length of the hydraulic cylinder can be 5 meters and more, while the plunger length is up to 2 meters, the plunger diameter and the inner diameter of the hydraulic cylinder varying in a range of 28 to 102 mm. These components are manufactured using complex machine tools and manufacturing process is very costly.

The wells having a significant gas content in the fluid being pumped require application of special devices which complicates the pump design and increases its price.

Also known in the art are plunger pumps comprising a housing with a cylindrical bore accommodating suction and discharge valves and a stationary sealing device. A smooth plunger is located in the cylindrical bore of the housing with a pap and reciprocates therein. The plunger is sealed by a stationary sealing device whose length is relatively small. The gap between the housing wall and the plunger is sufficiently large to avoid contact of the plunger with the housing. As a rule, such pumps are used in the surface equipment (cf. A. B. Bezzubov, Yu. V. Schelkalin "Oil Lifting Pumps", Moscow, Nedra, 1986, p. 194, FIG. 82).

In such pumps the plunger stroke is comparatively short. With a long stroke the pap between the housing and plunger much increases the so called "dead" space in the pump working chamber reducing the pump efficiency, particularly when the pumps are used in well with a high gas factor.

The use of a special valve in the sucker rod pumps makes it possible to reduce the adverse effect of the gas factor on the pump productivity. Known in the art is a sucker rod pump comprising a hydraulic cylinder with a suction valve, moving in the hydraulic cylinder a plunger having a discharge valve and forming a precision pair with the hydraulic cylinder, as well as a special valve in the pump upper portion, which is also made as a precision element to prevent gas looks in the pump (U.S. Pat. No. 4,219,311).

In such a pump the negative effect of the gas factor on the pump operation is reduced but at the expense of a special construction complicating the whole pump. In addition, there is also used an expensive and labor-consuming "hydraulic cylinder—plunger" precision pair.

SUMMARY OF THE INVENTION

The basic object of the invention is to provide a sucker rod pump that needs no a precision pair "hydraulic cylinder—plunger" while the elimination of the gas factor is made without using additional units in the pump system.

This object is attained by providing a sucker rod pump comprising a cylindrical housing with a suction valve, a stationary sealing device arranged on the cylindrical housing, and a hollow plunger with a discharge valve made with a possibility of reciprocating alone the cylindrical housing and interacting with the stationary sealing device; according to the invention, located in the cylindrical housing between the suction valve and the stationary sealing device is at least one additional sealing device spaced from the first sealing device and from one another, interacting with the hollow plunger whose length is equal to or larger than the sum of the distance between the adjacent sealing devices and the length of one sealing device but less than the sum of the double distance between the adjacent sealing devices and the length of one sealing device.

Such a pump has no "hydraulic cylinder-plunger" precision pair and, as described below, the pump makes it possible to remove the gas accumulated in the working chamber to eliminate the gas locks without using a special valve.

BRIEF DESCRIPTION OF THE DRAWINGS

The invention will be further described by way of example with reference to the accompanying drawing, in which.

DETAILED DESCRIPTION OF THE PREFERRED EMBODIMENT OF THE INVENTION

Figure 1:
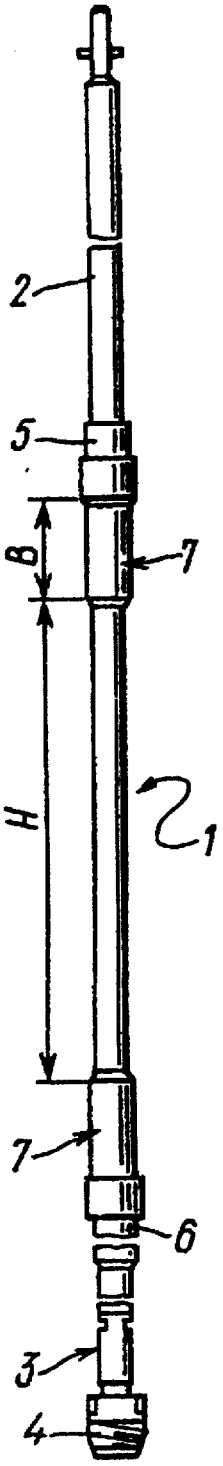
FIG. 1 is a general view of the sucker rod pump, according to the invention.

The sucker rod pump comprises a cylindrical housing 1 (FIG. 1), in which a plunger 2 performs a reciprocating motion. Mounted on the housing 1 at its one end is a suction valve 3 carrying a nipple 4 while the other end of the housing 1 has an adapter 5 through which the pump is screwed to the tubing. The housing 1 is made of two parts: a housing 1 proper and a lower part 6 of the housing. Arranged alone the housing 1 are several stationary sealing devices 7, two of which are shown in the drawing for simplicity. The devices 7 are spaced at some distance H from each other, while the plunger 2 interacts alternately with every sealing device 7.

The length L of the plunger 2 is selected so that it is equal to or greater than the sum of the distance H between the adjacent sealing devices 7 and the length B of one sealing device but less than the sum of the double distance H between the adjacent sealing devices 7 and the length B of one sealing device 7, i.e. $H+B<L<2H+B$.

The length L of the plunger 2 cannot be lower than H+B, because in this case the continuity of the suction-and-discharge process is not provided, i.e. the working chamber is depressurized. On the other hand, the length L of the plunger 2 must not be greater than 2H+B, because in this case no condition is provided for removal of the gas accumulated in the working chamber.

Figure 2:
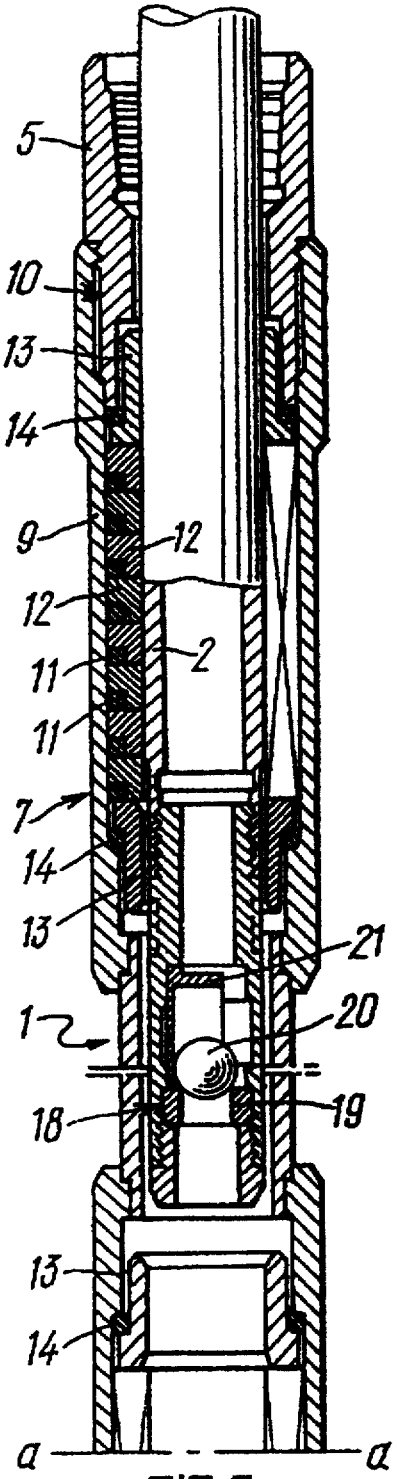
FIGS. 2 and 2*a* show an elevation of the same pump, according to the invention.
Figure 2A:
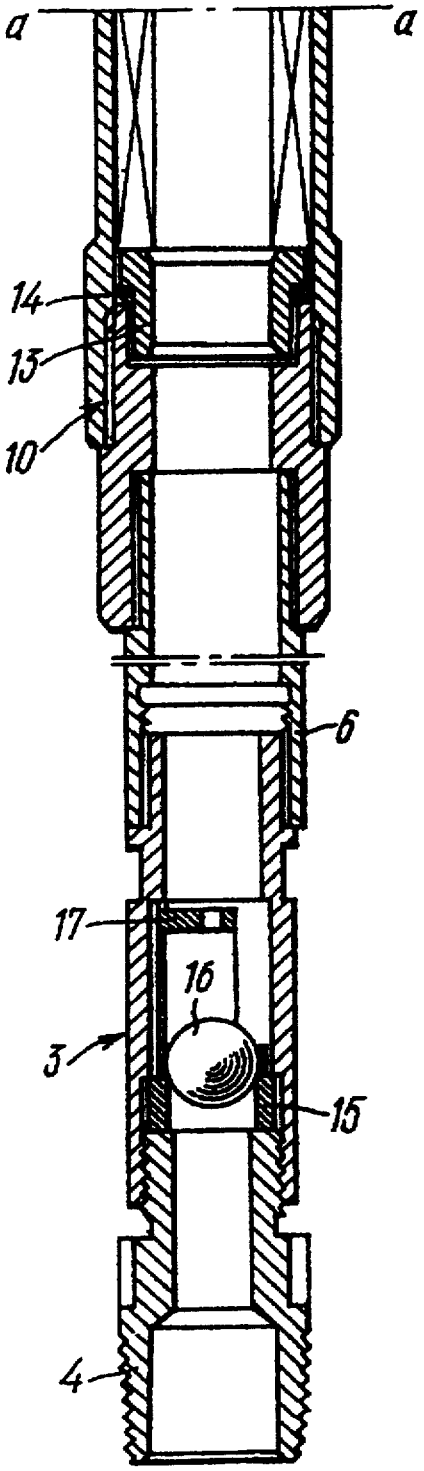

The use of the mechanical sealing devices 7 shown in FIG. 2 is preferable. Each device 7 comprises a housing 9 connected by thread 10 to the adapter 5, or to the housing 1, or to the lower part 6 of the housing 1. Mounted in the housing 9 are O-rings 11 made of an elastic material, installed in the grooves of the sealing eccentric rings and interacting with the internal surface of the housing 9.

The eccentric rings 12 are squeezed at both sides by the guide bushings 13 having their own seals in the form of O-rings.

The plunger 2 made as a hollow element is placed in the housing 1 with a gap, moves therein and interacts alternately with every sealing device 7.

The suction valve 3 comprises a seat 15 and a ball 16 moving in the valve cage 17. The discharge valve 18 disposed in the plunger 2 is made in a similar way and comprises a seat 19 and a ball 20 moving in a cage 21.

The sucker rod pump operates as follows.

Figures 3A, 3B, 3C, 3D, 3E:
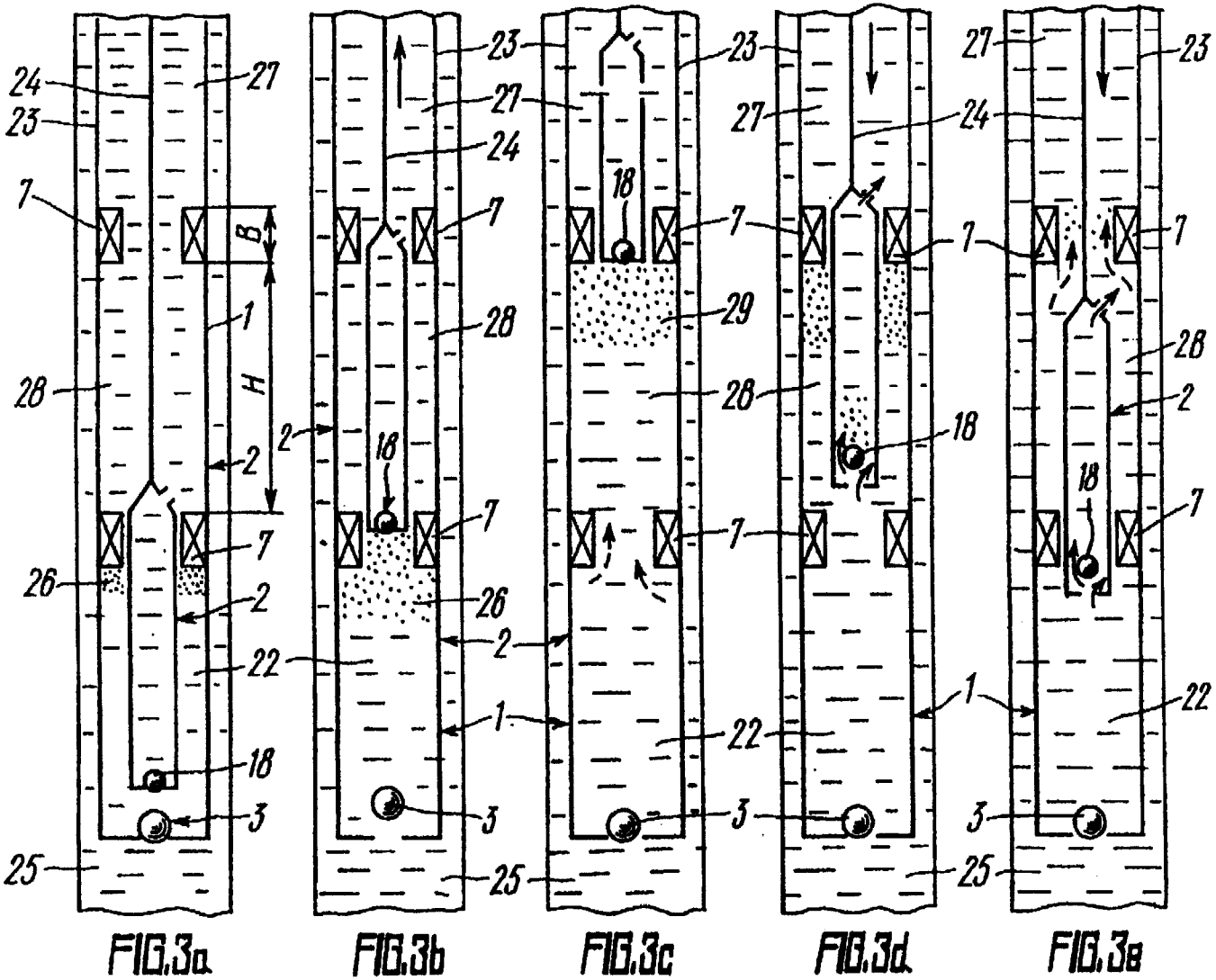
FIGS. 3*a, b, c, d* and *e* show a schematic operational diagram of the sucker rod pump, according to the invention.

FIG. 3*a, b, c, d, e* shows the steps of movement of the plunger 2 in the pump working chamber 22 formed by a cylindrical housing 1 (FIG. 1) and communicating with the tubing 23 (FIG. 3). The plunger 2 is connected to a sucker-rod string 24 and the whole pump is submerged into a well 25.

When the plunger 2 is in the bottom dead point (FIG. 3*a*), the valves 3 and 18 are closed and the pressure of the fluid in the working chamber 22 is equal to that in the tubing 23. The gas filled the working chamber 22 during the preceding suction stroke is partly dissolved in the fluid and partly in a free state in the upper part 26 of the chamber 22.

When the plunger 2 starts moving upward (FIG. 3*b*), the gas in the upper part 26 of the chamber 22 expands until the pressure under the suction valve 3 overcomes that in the working chamber 22. Then the valve 3 opens and the fluid from the well 25 flows into the chamber 22. Since the dead space volume of the chamber 22 is small compared to the total volume of the fluid displaced by the plunger 2 per stroke, the delay in opening the valve 3 is insignificant.

While the plunger 2 continues moving upward, its upper portion enters the top sealing device 7 whereas its bottom portion leaves the lower sealing device 7. At this moment the chamber 28 is cut off from the pressure line 27 of the pump and is not filled with fluid from the well 25 through the open valve 3 and chamber 22. During the upward movement of the plunger 2 the chamber 28 keeps a portion of the fluid whose volume is equal to that of the annular space between the housing 1 and the plunger 2. This fluid contains a small amount of dissolved gas which practically has no effect on the pump filling-up factor.

When the plunger 2 is in the top dead point (FIG. 3*c*), the spaces of the chambers 22 and 28 are filled with fluid and partially with gas concentrated in the upper part 29 of the chamber 28. During the reverse stroke of the plunger 2 (FIG. 3*d*) downwards the gas is compressed and the fluid pressure in the chambers 22 and 28 increases. When the pressure in the chambers 22 and 28 overcomes the pressure of the fluid column in the tubes 23, the discharge valve 18 opens and the continued motion of the plunger 2 downwards enables the fluid to enter the pressure line 27 of the pump.

When the plunger 2 passes by the lower sealing device 7 (FIG. 3*e*) and separates the chambers 22 and 28, the chamber 28 communicates with the pressure line 27 and, at the same time, the gas from the chamber 28 enters this pressure line 27.

Therefore, look of the pump with gas is eliminated in spite of the fact that the total "dead" space of the claimed pump is larger than in the prior art pumps, it operates with high volume efficiency.

Industrial Applicability

The invention can be used for pumping out oil and other fluids, having an increased amount of gas, from wells.

I claim:

1. A sucker rod pump comprising a cylindrical housing (1) having a suction valve (3), a first stationary sealing device (7) arranged on the cylindrical housing (1), and a hollow plunger (2) with a discharge valve (18) capable of reciprocating alone the cylindrical housing (1) and interacting with the stationary sealing device (7), characterized in that between the suction valve (3) and the stationary sealing device (7) in the cylindrical housing (1) there is located at least one additional stationary sealing device (7) spaced from said first sealing device (7) and from each other and interacting with the hollow plunger (2) whose length (L) is equal to or greater than the sum of a distance (H) between the adjacent sealing devices (7) and a length (B) of one sealing device (7) but less than the sum of a double distance (H) between the adjacent sealing devices (7) and the length (B) of one sealing device (7).

* * * * *